United States Patent [19]

McLean et al.

[11] Patent Number: 4,816,141

[45] Date of Patent: Mar. 28, 1989

[54] CATALYTIC TWO-STAGE LIQUEFACTION OF COAL UTILIZING CASCADING OF USED EBULLATED-BED CATALYST

[75] Inventors: Joseph B. McLean, S. Somerville, N.J.; Alfred G. Comolli, Yardley, Pa.; James B. MacArthur, Denville, N.J.

[73] Assignee: HRI, Inc., Lawrenceville, N.J.

[21] Appl. No.: 109,645

[22] Filed: Oct. 16, 1987

[51] Int. Cl.[4] ..... C10G 1/08

[52] U.S. Cl. ..... 208/413; 208/418; 208/423

[58] Field of Search ..... 208/408, 412, 413, 415, 208/418, 423

[56] References Cited

U.S. PATENT DOCUMENTS

| | | | |
|---|---|---|---|
| 3,594,303 | 7/1971 | Kirk, Jr. | 208/413 X |
| 3,679,573 | 7/1972 | Johnson | 208/413 |
| 3,700,584 | 10/1972 | Johanson et al. | 208/413 |
| 4,111,788 | 9/1978 | Chervenak et al. | 208/413 X |
| 4,330,393 | 5/1982 | Rosenthal et al. | 208/413 |
| 4,411,767 | 10/1983 | Garg | 208/413 |
| 4,495,055 | 1/1985 | Comolli et al. | 208/413 |

*Primary Examiner*—Glenn Caldarola
*Attorney, Agent, or Firm*—Fred A. Wilson

[57] ABSTRACT

A multi-stage catalytic process for hydrogenation and liquefaction of coal using ebullated-bed catalytic reactors to produce low-boiling hydrocarbon liquid products, in which used catalyst is removed from a lower temperature first stage reactor operating at temperature not exceeding about 800° F. and cascaded forward to a higher temperature second stage reactor for further use therein. Reaction conditions in the first stage reactor are preferably 700°-800° F. temperature, 1000-4000 psig hydrogen partial pressure, and a coal feed rate of 10-90 lb coal/hr per $ft^3$ catalyst settled volume in the reactor. Useful higher temperature or second stage reaction conditions are 750°-850° F. temperature, and 1000-4000 psig hydrogen partial pressure. The used catalyst withdrawn from the lower temperature of first stage reactor has a catalyst age of 300-3000 lb coal proceses/lb fresh catalyst, and is transferred forward to the higher temperature second stage reactor for further use to catalyst age of 1000-6000 lb coal processed per lb fresh catalyst. If desired, a higher temperature third catalytic reactor can be provided and used catalyst from the second stage reactor cascaded forward into the third reactor for further use therein. Useful catalysts include metal oxides of cobalt, iron, molybdenum, nickel, tin, or tungsten deposited on a base of alumina, magnesia, silica, or titania, with cobalt moly and nickel moly on alumina catalyst being preferred. This process advantageously requires a smaller quantity of fresh catalyst per ton of coal processed to produce the low-boiling hydrocarbon liquid products.

16 Claims, 2 Drawing Sheets

CATALYTIC TWO-STAGE LIQUEFACTION OF COAL UTILIZING CASCADING OF USED EBULLATED-BED CATALYST

BACKGROUND OF INVENTION

This invention pertains to catalytic two-stage hydrogenation and liquefaction of coal using temperature staged ebullated-bed catalytic reactors to produce low-boiling hydrocarbon liquid products. It pertains particularly to such a process in which used catalyst is removed from a lower temperature first stage ebullated-bed reactor and cascaded forward to a higher temperature second stage ebullated-bed reactor for further use, so as to reduce the fresh catalyst requirements for the process.

In the catalytic hydrogenation and liquefaction of coal to produce hydrocarbon liquid products, various two-stage catalytic processes have been proposed including processes utilizing relatively low first stage reaction temperatures of only 600°-750° F. Examples of such prior coal liquefaction processes using two catalytic reaction stages connected in series are disclosed by U.S. Pat. Nos. 3,679,573, 3,700,584, 4,111,788, 4,350,582, 4,354,920, and 4,358,359. In such catalytic coal liquefaction processes, the catalyst costs are significant due to catalyst deactivation caused by carbon and metals deposition on the catalyst, which requires replacement with fresh or regenerated catalyst. Usually the catalyst in the reactors undergoes rapid deactivation due to accumulation of carbon and metals, such as calcium, iron, titanium, etc. Recognizing this problem, U.S. Pat. No. 3,679,573 to Johnson discloses a catalytic two-stage coal liquefaction process in which used catalyst is removed from the second stage reactor and further utilized at the same reaction conditions in the first stage reactor, where the catalyst accumulates deposits of metallic contaminants such as titanium in the form of titanium dioxide which rapidly deactivates the catalyst, so that it requires replacement sooner or at a higher rate than is economically desirable. Thus, the used catalyst is transferred from the second to the first stage reactor countercurrent to the coal feed direction.

But contrary to the teachings of this Johnson patent and the prior art, we have unexpectedly discovered that carbon and metals deposits on the used catalyst in a lower temperature first stage reactor does not prevent its effective use in a higher temperature second stage reactor. We have now developed a process for catalytic two-stage hydrogenation and liquefaction of coal in which used catalyst removed from the lower temperature first stage catalytic reactor has been unexpectedly found desirable and useful in the higher temperature second stage catalytic reactor, so that the total consumption of fresh catalyst per unit quantity of coal processed is significantly reduced.

SUMMARY OF INVENTION

The present invention provides a staged catalytic coal hydrogenation and liquefaction process for producing low-boiling hydrocarbon liquid products, in which the lower temperature or first stage reactor temperature does not exceed about 800° F. and used catalyst is removed from the lower temperature or first stage ebullated-bed reactor and is cascaded forward to a higher temperature or second stage ebullated-bed reactor for further use therein, and achieve high conversion of the coal and longer useful life for the catalyst. In the process, the used catalyst is withdrawn from the lower temperature, preferably first stage reactor, and transferred to the higher temperature, preferably second stage reactor, with the reactors being designated by the coal flow sequence through the process. A particulate coal such as bituminus or sub-bituminous coal and a heavy hydrocarbon liquid solvent material normally boiling above about 600° F. are first mixed together to provide a solvent/coal weight ratio of between about 1.0 and 4.0. The resulting coal-oil slurry is catalytically hydrogenated and liquefied using two staged ebullated-bed catalytic reactors connected in a series arrangement. The first stage reactor preferably operates at a lower temperature of 700°-800° F. temperature, and the second stage reactor higher temperature is 750°-860° F. and at least about 25° F. higher than the first stage reactor temperature. Alternatively, the first stage reaction zone can be operated at the higher 750°-860° F. temperature and the second stage reaction zone operated at the lower 700°-800° F. temperature. Useful space velocity is 10-90 lb coal/hr per $ft^3$ catalyst settled volume in the reactors.

It has been found that lower catalyst deactivation rates occur in the lower temperature first stage reactor than in the higher temperature second stage reactor, apparently because of the lower operating temperatures and the better hydrogenation environment in the first stage reactor. The catalyst age in each reactor is controlled by withdrawing used catalyst from the lower temperature reactor and cascading it to the reactor having higher thermal severity, so that effective use can be made of catalytic activity remaining in the used catalyst removed from the lower temperature reactor. The used catalyst withdrawn from the lower temperature or first stage reactor should have an average age of 300-3000 lb coal processed/lb catalyst. Also, the used catalyst withdrawn from the higher temperature or second stage reactor should have an average catalyst age of at least 1000 lb coal processed/lb catalyst and preferably 1000-6000 lb/lb. By use of this invention, significantly more feed coal can be advantageously hydrogenated and liquefied per pound of fresh catalyst used, or alternatively significantly less fresh catalyst is required per ton of coal processed to produce desired low-boiling hydrocarbon liquid products.

The coal feed for this process may be bituminous coal such as Illinois No. 6 or Kentucky No. 11; sub-bituminous coal such as Wyodak, or lignite. The coal is usually mixed with a coal-derived slurrying oil from the process and having a normal boiling range of 500°-1050° F., with at least about 50% of the slurrying oil preferably having a normal boiling temperature above about 850° F. Also, suitable slurrying oil for the coal may be selected from the group consisting of petroleum-derived residual oil, shale oil, tar sand bitumen, and oil derived from coal from another coal liquefaction process.

The coal-oil slurry is fed into the lower temperature first stage catalytic reaction zone which is maintained at selected moderate temperature and pressure conditions and in the presence of a particulate hydrogenation catalyst which promotes controlled rate hydrogenation and liquefaction of the coal, while simultaneously hydrogenating the solvent oil at conditions which favor such hydrogenation reactions at conditions which favor such hydrogenation reactions at temperatures usually less than about 800° F. The first stage reaction zone contains an ebullated-bed of particulate hydrogenation catalyst to hydrogenate the particulate feed coal, solvent oil and dissolved coal molecules and produce desired low-boiling hydrocarbon liquid and gaseous materials.

The first stage reaction zone is preferably maintained at conditions of 700°–800° F. temperature, 1000–4000 psig hydrogen partial pressure, and coal feed rate or space velocity of 10–90 lb coal/hr per $ft^3$ catalyst settled volume to liquefy the coal and produce a high quality hydrocarbon solvent material, while achieving greater than about 80 W % conversion of the coal to tetrahydrofuran (THF) soluble materials. At such mild reaction conditions, hydrocracking, condensation and polymerization reactions along with formation of undesired hydrocarbon gases are all advantageously minimized and the mild reaction conditions used permit the catalytic hydrogenation reactions to keep pace with the rate of coal conversion. Preferred first stage reaction conditions are 720°–780° F. temperature; 1500–3500 psig hydrogen partial pressure and coal space velocity of 20–70 lbs coal/hr per $ft^3$ catalyst settled volume, with the preferred conditions being specific to the type of coal being processed.

The catalyst used is selected from the group consisting of oxides of cobalt, iron, molybdenum, nickel, tin, tungsten and other hydrocarbon hydrogenation catalyst metal oxides known in the art, deposited on a base material selected from the group consisting of alumina, magnesia, silica, titania, and similar materials. Useful catalyst particle sizes can range from about 0.030 to 0.125 inch effective diameter and can be any shape including spherical beads or extrudates.

From the first stage reaction zone, the total effluent material is passed with additional hydrogen to the second stage catalytic reaction zone, where the material is further hydrogenated and hydrocracked at a temperature at least about 25° F. higher than for the first stage reaction zone. Both stage reaction zones are upflow, well mixed ebullated-bed catalytic reactors, with the second stage reaction zone being preferably close-coupled to the first stage reaction zone; however, gaseous material can be withdrawn interstage if desired. For the second stage reactor, the reaction conditions are maintained at higher severity which promotes more complete thermal conversion of the coal to liquids, hydroconversion of primary liquids to distillate products, and product quality improvement via heteroatoms removal at temperature greater than 800° F., and hydrogen partial pressure similar to the first stage reaction zone. The desired second stage reaction conditions are 750°–860° F. temperature, 1000–4000 psig hydrogen partial pressure and coal space velocity of 10–90 lb coal/hr per $ft^3$ catalyst settled volume to achieve at least about 90 W % conversion of the remaining reactive coal along with the asphaltene and preasphaltene compounds to lower boiling hydrocarbon materials, and the heteroatoms are further reduced to provide THF soluble materials. The reactor space velocity is adjusted to achieve substantially complete conversion of the 650° F.+ heavy oils and residuum to 650° F.− liquid products. Preferred second stage reaction conditions are 780°–850° F. temperature, 1500–3500 psig hydrogen partial pressure and coal space velocity of 20–70 lb coal/hr per $ft^3$ catalyst settled volume.

This two-stage catalytic coal liquefaction process provides high selectivity to low-boiling hydrocarbon liquid products and desired low yields of $C_1$–$C_3$ hydrocarbon gases and residuum materials, together with minimal deactivation of the catalyst, which provides for extended activity and useful life of the catalyst. Although the present catalytic two-stage hydrogenation process produces high yields of distillate and lower molecular weight hydrocarbon products, it may be desirable for some coal feed materials to utilize a third higher temperature catalytic reactor, in which used catalyst may be withdrawn from the second reactor and cascaded forward to the third reactor. If such a third stage reactor is used, its temperature should be at least about 25° F. higher than that of the second stage reactor, but below about 860° F.

The present multi-staged coal liquefaction process advantageously provides a significant improvement over prior two-stage coal liquefaction processes, by providing for forward cascading of used catalyst from the lower temperature first stage reaction zone to the next succeeding higher temperature reaction zone. The reaction conditions are selected to provide controlled hydrogenation and conversion of the coal to mainly low-boiling liquid products, while simultaneously hydrogenating the recycle and coal-derived product oils. Because the coal feed is dissolved in a high quality hydrocarbon solvent in the lower temperature first-stage reactor, the potential for retrogressive (coke forming) reactions is significantly reduced and solvent quality, hydrogen utilization and heteroatom removal are appreciably improved, which increases potential conversion of the coal while also extending the catalyst effective life.

The present process is advantageously improved over other two-stage coal liquefaction processes and achieves high yields of hydrocarbon distillate and lower molecular weight liquid products and lower fresh catalyst usage than for other catalytic two-stage coal hydrogenation and liquefaction processes. Also, the used cascaded catalyst withdrawn from the higher temperature second stage reactor has less carbon deposits than used originally fresh catalyst from the second stage reactor, and has a lower deactivation rate than the originally fresh catalyst. The net products from the process are controlled to yield $C_1$–$C_3$ gases, $C_4$-750° F. distillate, and a solids stream containing principally unconvertable mineral matter or ash. Also, the preferred recycle of heavy 650° F.+ hydrocarbon liquid materials to the first stage reactor eliminates any net production of these undesirable heavy oils, which are believed to have carcinogenic and mutenogenic characteristics. By use of the invention, the overall effective age of used catalyst is increased by up to about 100%, so that the fresh catalyst required per ton of coal processed to produce desired low-boiling hydrocarbon liquid products is reduced by up to about 50%.

BRIEF DESCRIPTION OF INVENTION

DESCRIPTION OF INVENTION

Figure 1:
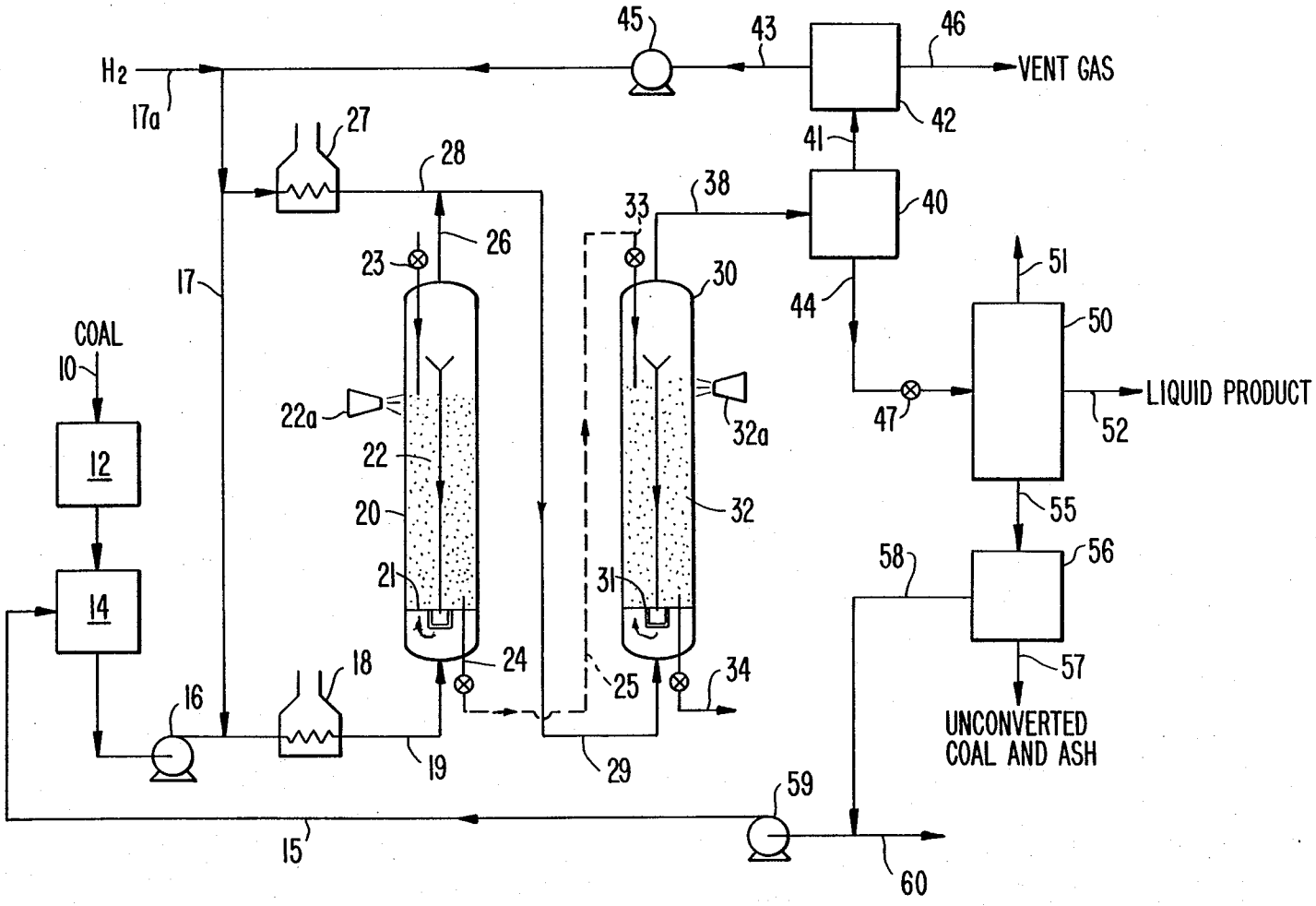
FIG. 1 is a schematic flow diagram of a catalytic two-stage coal hydrogenation and liquefaction process utilizing cascaded catalyst in accordance with the invention.

In the present invention, improved hydrogenation and liquefaction of coal is achieved by a two-stage catalytic process using two well-mixed ebullated-bed catalytic reactors which are preferably direct-connected in series arrangement. As is shown in FIG. 1, a coal such as Illinois No. 6 bituminous or Wyodak sub-bituminous type is provided at 10 and passed through a coal preparation unit 12, where the coal is ground to a desired particle size range of 50–375 mesh (U.S. Sieve Series) and dried to a desired moisture content of 2–8 W % moisture. The particulate coal is then slurried at tank 14 with sufficient process-derived recycle solvent liquid 15 having a normal boiling temperature above about 650° F. to provide a flowable slurry. The weight ratio of solvent oil/coal is usually in a range of 1.0–4.0, with 1.1–3.0 ratio usually being preferred. The coal/oil slurry is pressurized at pump 16, mixed with recycled hydrogen at 17, preheated at heater 18 to 600°–650° F. temperature and is then fed into the lower end of first stage catalytic ebullated-bed reactor 20. Fresh make-up high-purity hydrogen is provided at 17*a* as needed.

The coal/oil slurry and hydrogen streams enter reactor 20 containing an ebullated catalyst bed 22, passing uniformly upwardly through flow distributor 21 at a flow rate and at temperature and pressure conditions to accomplish the desired hydrogenation reactions therein. The operation of the ebullated-bed catalytic reactor including recycle of reactor liquid upwardly through the expanded catalyst bed is generally well known and is described by U.S. Pat. No. 4,437,973, which is incorporated herein by reference to the extent needed. The first stage reactor 20 contains a particulate hydrogenation catalyst which is preferably cobalt molybdate, nickel molybdate, or nickel tungsten on an alumina or silica support material. In addition, fresh particulate hydrogenation catalyst may be added to reactor 20 at connection 23 in the ratio of about 0.1 to 2.0 pounds of catalyst per ton of coal processed. The upper level of ebullated-bed 22 is monitored by nuclear device 22*a* for detecting the catalyst level therein. Spent catalyst may be removed from reactor 20 at connection 24 to maintain the desired catalytic activity within the reactor 20, and transferred to the second stage reactor as described further herein below.

Operating conditions in the first stage reactor are maintained at moderate temperature range of 710°–800° F., 1000–4000 psig hydrogen partial pressure, and coal feed rate or space velocity of 10–90 lb coal/hr per $ft^3$ catalyst settled volume in the reactor. The preferred reaction conditions are 720°–780° F. temperature, 1500–3500 psig hydrogen partial pressure and feed rate of 20–70 lb coal/hr per $ft^3$ catalyst settled volume in the reactor and will be specific to the particular coal being processed, because different coals convert to liquids at different rates. The optimal first stage reaction conditions will allow maximum utilization of hydrogen shuttling solvent compounds, such as pyrene/hydropyrenes known to be present in coal-derived recycled oils, since catalytic rehydrogenation of donor species occurs simultaneously with solvent-to-coal hydrogen transfer. Coal-derived oils are also exposed to an efficient catalytic hydrogenation atmosphere immediately upon their formation, thereby reducing the tendency for regressive repolymerization reactions which lead to poor quality hydrocarbon liquid products. First stage reactor thermal severity has been found to be quite important, as too high a severity leads to a coal conversion rate which is too rapid for the catalytic hydrogenation reactions to keep pace, as well as provides poorer hydrogenation equilibrium for the solvent compounds. Too low a thermal severity in the first stage, while still providing an efficient atmosphere for solvent hydrogenation, does not yield sufficient coal conversion to provide a significant process improvement.

In the first stage reactor, the objective is to hydrogenate the aromatic rings in molecules of the feed coal, recycle solvent and dissolved coal so as to produce a high quality hydrogen donor solvent liquid in the presence of hydrogen and the hydrogenation catalyst. At the moderate catalytic reaction conditions used, heteroatoms are removed, retrogressive or coke forming reactions are essentially eliminated, and hydrocarbon gas formations are effectively minimized. Because of the reaction conditions used, i.e., relatively low temperature first stage, the catalyst promotes coal hydrogenation and minimizes polymerization and cracking reactions. Also because of these improved conditions in the first stage reactor, less coke is deposited on the catalyst at the milder and favorable hydrogenation reaction conditions used, and the deposited coke also has a desirably higher hydrogen/carbon ratio than for prior coal liquefaction processes, which minimizes catalyst deactivation and appreciably prolongs the effective life of the catalyst.

From the first stage reactor 20, the total effluent material at 26 is mixed with additional hydrogen 28 preheated at 27 and flows through conduit 29 directly to the lower end of close-coupled second stage catalytic reactor 30. The term close-coupled reactors used herein means that the volume of connecting conduit 29 extending between the first and second stage reactors is limited to only about 2–8% of the volume of the first reactor, and is preferably only 2.4–6% of the first reactor volume. Reactor 30 operates similarly to reactor 20 and contains flow distributor grid 31 and catalyst ebullated-bed 32, and is operated at a temperature at least about 25° F. higher than that for the first stage reactor, and usually in the temperature range of 760°–860° F. The higher temperature used in reactor 30 may be accomplished by utilization of the preheated hydrogen stream 28 as well as the second stage reactor heat of reaction. The second stage reactor pressure is sufficiently lower than for the first stage reactor to permit forward flow of the first stage material without any need for pumping, and additional make-up hydrogen is added at 28 to the second stage reactor as needed. A particulate catalyst similar to that used in the first stage reactor is utilized in the second stage reactor ebullated-bed 32, and is preferably cobalt-moly or nickel-moly on porous alumina support material. The upper level of ebullated-bed 32 is monitored by a nuclear device 32*a* for detecting the catalyst level therein.

Make-up catalyst is supplied to ebullated-bed 32 of reactor 30 from used catalyst withdrawn at 24 from first stage reactor catalyst bed 22. This first stage used catalyst can be either withdrawn at connection 24 periodically and added to reactor 30 at connection 33, or it can be transferred forward through conduit 25 shown in dotted lines in FIG. 1. The used catalyst withdrawn from first stage reactor bed 22 should have an average catalyst age of 500–1500 Lb coal processed/Lb catalyst. Also, an average contaminant level or a catalyst activity test could be used to ascertain when to cascade forward the used catalyst and at what rate. Because the total pressure of reactor 30 will be at least about 50–100 psi lower than the pressure of first stage reactor 20, a catalyst-oil slurry from bed 22 can be transferred to reactor bed 32 without difficulty. The used catalyst from ebullated-bed 32 is withdrawn at connection 34, and may be discarded or regenerated for further use in the process.

In the second stage reactor 30, the reaction conditions are selected to provide a more complete catalytic conversion of the unconverted coal to liquids, utilizing the high quality solvent liquid produced in the first stage reactor. The remaining reactive coal as well as preasphaltenes and asphaltenes are converted to distillate liquid products along with additional heteroatoms removal. Substantial secondary conversion of coal-derived liquids to distillate products, and product upgrading by heteroatoms removal, is also accomplished in the second stage reactor. The reaction conditions are selected to minimize gas formation or dehydrogenation of the first stage liquid effluent materials. Useful reactor conditions are 750°–860° F. temperature, 1000–4000 psig hydrogen partial pressure, and coal space velocity of 10–90 lb coal/hr per $ft^3$ catalyst settled volume. Preferred reaction conditions will depend on the particular type coal being processed, and are usually 760°–850° F. temperature, 1500–3500 psig hydrogen partial pressure, and space velocity of 20–70 lb coal/hr per $ft^3$ catalyst settled volume.

From the second stage reactor 30, the effluent material at 38 is passed to a phase separator 40 operating at near reactor conditions, wherein a vapor fraction 41 is separated from a solids-containing liquid slurry fraction at 44. The vapor fraction 41 is treated at hydrogen purification unit 42, from which hydrogen stream 43 is withdrawn for recycle by compressor 45 to the reactors 20 and 30. Fresh high purity make-up hydrogen is added at **17*a* as needed. A vent gas containing undesired nitrogen and sulfur compounds is removed as stream 46**.

The slurry liquid 44 is pressure-reduced at 47 to near atmospheric pressure, and passed to a distillation system generally shown at 50. The resulting liquid fractions are recovered by a vapor/liquid flash in the distillation system 50, which includes atmospheric and/or vacuum distillation steps to produce light distillate product stream 51 and a heavier higher-boiling distillate liquid product stream 52. A bottoms stream 55 is passed to an effective liquid-solids separation step 56, from which unconverted coal and ash solids material is removed at 57. The remaining liquid stream 58 having a solids concentration less than about 30W % solids and preferably 0–20 W % solids is recycled by pump 59 as the slurring oil 15 to slurry tank 14.

The unconverted coal and ash solids are preferably substantially completely removed to provide for recycle of a 600° F.+ heavy hydrocarbon stream to the coal slurrying step, so as to achieve substantially total conversion of all the 600° F.+ oils to light distillate products and avoid production of heavy oils which are generally considered carcinogenic. The recycle oil preparation in liquid-solids separation step 56 can be improved by reducing its solids concentration (ash and unconverted coal) to less than about 20 W % and preferably 0–15 W % by using known solids removal means in separation step 56, such as by use of centrifuges, filtration, extraction or solvent deashing techniques known in the industry. This slurrying liquid at 58 is recycled as stream 15 back to the mixing step at 14, where it is mixed with the coal feed to the first stage reactor 20 to provide an oil/coal weight ratio of 1.0–4.0, and preferably 1.1–3.0 ratio. If desired, a reduced solids concentration product stream can be withdrawn at 60.

This invention will be further described by the following examples, which should not be construed as limiting the scope of the invention.

EXAMPLE 1

To demonstrate the advantage of utilizing in a second stage reactor particulate used catalyst removed from a lower temperature first stage reactor, a composited sample of used Amocat 1C nickel-moly 1/16" diameter extrudate catalyst was prepared. The fresh Amocat 1C catalyst had properties as shown in Table 1. The composited used catalyst sample had average age of 32 days on stream, which is equivalent to about 900 lb coal processed/lb catalyst in the reactor. The used catalyst sample was installed in the second stage 2000 cc ebullated-bed reactor of a bench-scale continuous coal liquefaction unit having a throughput of 30–50 lb/day, with fresh Amocat 1C catalyst in the first stage reactor. The two-stage unit was operated for a period of nine days at conditions identical to a previous run which initially had fresh Amocat 1C catalyst in both the first and second stage reactors. The operating conditions and results are shown in Table 2 below. Although the 2000 cc reactors used batch type catalyst in ebullated beds which were too small to permit addition and withdrawal of catalyst during operations, the equivalent kinetic catalyst age values were calculated from the days on stream data.

TABLE 1

TYPICAL FRESH CATALYST PROPERTIES

| | |
|---|---|
| Catalyst | Amocat 1C |
| Size | 0.062 in. diameter extrudates |
| Promotors, W % | |
| Molybdenum | 9.6 |
| Nickel | 2.6 |
| Porosity | Bimodal |
| Pore volume, cc/gm | 0.80 |
| Bulk density, gm/cc | 0.57 |

TABLE 2

CONDITIONS AND RESULTS FOR CATALYST COMPARISON RUNS

| | Catalyst Mode | |
|---|---|---|
| Condition | Conventional | Cascaded |
| Solvent/Coal Weight Ratio | 1.6 | 1.6 |
| Reactor Temperature, °F. | | |
| First Stage | 750 | 750 |
| Second Stage | 800 | 800 |
| Hydrogen Partial Pressure, psig | 2500 | 2500 |
| Coal Space Velocity, lb/hr per $ft^3$ | 46 | 46 |
| Hydrogen Rate, SCF/lb coal | 25 | 25 |
| CAS Reboiler Temperature, °F. | 610 | 610 |
| Catalyst Age, lb coal/lb catalyst | | |
| First Stage | 297 | 141 |
| Second Stage | 300 | 1288 |
| Overall | 298 | 715 |
| Yields, % M.A.F. Coal | | |
| $C_1$–$C_3$ Gases | 6.1 | 6.4 |
| $C_4$–390° F. Liquids | 19.2 | 17.3 |
| 390–650° F. Liquids | 33.7 | 34.2 |
| 650–975° F. Liquids | 16.7 | 18.6 |
| 975° F.+ Material | 9.0 | 9.0 |
| Unconverted Coal | 5.6 | 5.3 |
| Heteratoms | 16.7 | 16.2 |
| Total (100 + $H_2$ Reacted) | 107 | 107 |
| $C_4$–975° F., W % | 69.6 | 70.1 |

Figure 2:
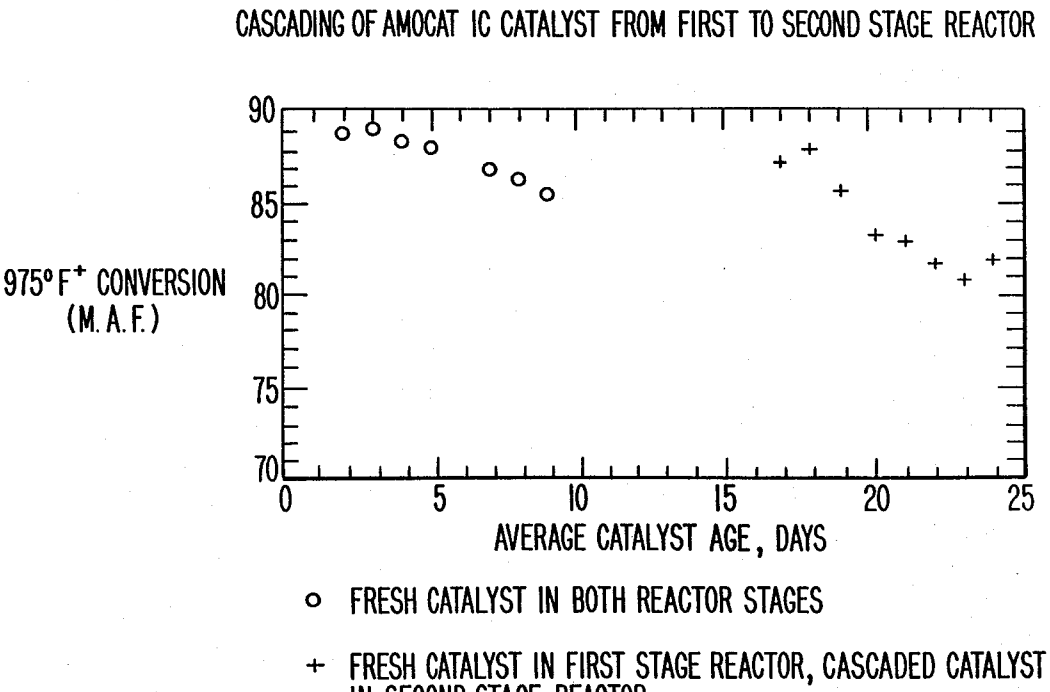
FIG. 2 is a graph showing the effect of forward cascading used catalyst from the lower temperature first stage reactor to the second stage reactor on the 975° F.+ conversion of M.A.F. coal.

Comparative 975° F.+ conversion results for the two runs are also provided in FIG. 2. It is seen that the catalyst forward cascading arrangement for particulate used catalyst from the low temperature first stage reactor to the higher temperature second stage reactor achieved similar hydrogenation results and product yields at significantly higher catalyst age of 18–25 days as compared to that for fresh catalyst, with the resulting catalytic activity and 975° F.+ conversion apparently leveling off for the cascaded catalyst toward the end of the period studied.

Comparative properties of the used catalysts typically found in first and second stage reactors as compared with catalyst cascaded to the second stage reactor are provided in Table 3.

TABLE 3

COMPARISON OF USED CATALYST PROPERTIES

| | TYPICAL | | CASCADED(1) |
|---|---|---|---|
| STAGES | FIRST | SECOND | SECOND |
| Catalyst Age, Days Total | 32 | 27 | 45 |
| Catalyst Age, lb coal/lb catalyst | 1152 | 850 | 1156 |
| % Carbon | 9.4 | 19.7 | 14.8 |
| H/C Atomic Ratio | 1.05 | 0.62 | 0.70 |

(1)Inspection of used first stage catalyst after being cascaded and operated in second stage reactor.

Based, on these results, it is also noted following shutdown of the ebullated bed reactor test unit that the used catalyst in the second stage reactor had a lower carbon content of only about 14.8 W %, instead of 19.7 W % carbon typically observed for used catalyst removed from the second stage reactor, even though the cascaded catalyst overall on-stream age of 45 days was higher than for typical used catalyst. Apparently prior catalyst use in the lower temperature first stage reactor "conditions" the catalyst so that its carbon deposition in the higher temperature second stage reactor is less severe than carbon deposition on fresh catalyst used in the second stage reactor. This reduced incremental accumulation of carbon deposits for the used catalyst in the second stage reactor contributes to the higher overall activity of the cascaded used catalyst. Although only the Amocat 1C used catalyst was tested in cascaded operations, it is believed that other commercial hydrogenation catalysts having similar properties and fluidization characteristics can be advantageouly utilized in the invention.

Thus, by use of the present invention the catalyst effective age can be significantly increased and the consumption of fresh catalyst reduced by up to about 50% for a particular throughput of coal to the liquefaction process.

Although this invention has been described broadly and in terms of certain preferred embodiments thereof, it will be understood that modifications and variation of the process can be made within the spirit and scope of the invention, which is defined by the following claims.

We claim:

1. A process for two-stage catalytic hydrogenation of coal to produce low-boiling hydrocarbon liquid and gaseous products, comprising:

(a) feeding particulate coal and a hydrocarbon slurrying oil at oil/coal weight ratio between 1.0 and 4.0 and at temperature below about 700° F. into a pressurized first stage catalytic reaction zone containing coal-derived liquid and hydrogen and an ebullated bed of particulate hydrogenation catalyst;

(b) passing said coal and hydrogen upwardly through said first stage ebullated bed of particulate hydrogenation catalyst, said bed being maintained at 700°–800° F. temperature, 1000–4000 psig hydrogen partial pressure and space velocity of 10–90 lb/hr per $ft^3$ settled catalyst volume to rapidly heat the coal and catalytically hydrogenate it to produce a partially hydrogenated and hydroconverted coal-derived material;

(c) withdrawing said partially hydrogenated coal-derived material containing gas and liquid fractions from said first stage reaction zone, and passing said material to a second stage catalytic reaction zone together with additional hydrogen, said second stage reaction zone being maintained at 750°–860° F. temperature and 1000–4000 psig hydrogen partial pressure for further reacting and hydrocracking the liquid fraction material therein with minimal dehydrogenation reactions to produce gas and lower boiling hydrocarbon liquid effluent materials;

(d) withdrawing used catalyst particles having an average age of about 300–3000 lb coal processed/lb catalyst from said first stage reaction zone, passing the used catalyst forward into said second stage reaction zone and withdrawing from said second stage reaction zone used catalyst having an average age at least about 1000 lb coal processed/Lb catalyst;

(e) withdrawing the effluent material from said second stage catalytic reaction zone and phase separating said effluent material into separate gas and liquid fractions;

(f) passing said liquid fraction to a distillation step and a liquid-solids separation step, from which a hydrocarbon liquid solvent stream normally boiling above about 600° F. and containing less than about 30 W % concentration of particulate solids is recycled as coal slurrying oil; and (g) recovering hydrocarbon gas and increased yields of low boiling $C_4$-650° F. hydrocarbon liquid products from the process.

2. The process of claim 1, wherein the particulate hydrogenation catalyst is selected from the group consisting of oxides of cobalt, iron, molybdenum, nickel, tin, tungsten and mixtures thereof deposited on a base material selected from the group consisting of alumina, magnesia, silica, and combinations thereof.

3. The process of claim 1, wherein the first stage reaction zone is maintained at 720°–780° F. temperature, 1500–3500 psig hydrogen partial pressure, and space velocity of 20–70 lb/hr per $ft^3$ catalyst settled volume.

4. The process of claim 1, wherein the second stage reaction zone is maintained at 760°–850° F. temperature and 1500–3500 psig hydrogen partial pressure.

5. The process of claim 1, wherein the first and second stage reaction zone contains a particulate hydrogenation catalyst comprising nickel and molybdenum deposited on an alumina support material.

6. The process of claim 1, wherein the first and second stage reaction zone contains a particulate catalyst comprising cobalt and molybdenum deposited on an alumina support material.

7. The process of claim 1, wherein the hydrogen to carbon ratio for the 650° F.+ fraction in the first stage reaction zone is greater than that in the second stage reaction zone.

8. The process of claim 1, wherein the used particulate catalyst removed from said first stage reaction zone has a catalyst average age of 600–1200 lb coal/lb catalyst.

9. The process of claim 1, wherein the used particulate catalyst withdrawn from said second stage reaction zone has a catalyst age of 1000–2500 lb coal processed/-catalyst.

10. The process of claim 1, wherein the used catalyst withdrawn from the second stage reaction zone has less carbon deposits than originally fresh used catalyst withdrawn from the second stage reactor.

11. The process of claim 1, wherein the coal feed is bituminous type coal.

12. The process of claim 1, wherein the coal feed is sub-bituminous type coal.

13. The process of claim 1, wherein said hydrocarbon slurrying oil is derived from the coal feed.

14. The process of claim 1, wherein said hydrocarbon slurrying oil is selected from the group consisting of petroleum derived residual oil, shale oil, tar sand bitumen, and heavy oil derived from another coal conversion process.

15. A process for two-stage catalytic hydrogenation of coal to produce increased yields of low-boiling hydrocarbon liquid and gaseous products, comprising:

(a) mixing particulate bituminous coal with sufficient coal-derived hydrocarbon liquid at an oil/coal weight ratio between 1.1 and 3.0 to provide a flowable slurry, and feeding the coal-oil slurry at temperature below about 650° F. directly into a pressurized first stage catalytic reaction zone containing coal-derived liquid and hydrogen and an ebullated bed of particulate hydrogenation catalyst;

(b) passing the coal slurry and hydrogen upwardly through said first stage ebullated bed of particulate hydrogenation catalyst, said bed being maintained at 720°–780° F. temperature, 1500–3500 psig hydrogen partial pressure, and space velocity of 20–70 lb/hr per $ft^3$ catalyst to rapidly heat the coal and catalytically hydrogenate it to produce a partialy hydrogenated and hydroconverted coal-derived material;

(c) withdrawing said partially hydrogenated coal-derived material containing gas and liquid fractions from said first stage reaction zone, and passing said material directly to a close-coupled second stage catalytic reaction zone together with additional hydrogen, said second stage reaction zone being maintained at 760°–850° F. temperature and 1500–3500 psig hydrogen partial pressure for further reaction and hydrocracking the liquid fraction therein with minimal dehydrogenation reactions to produce gas and low boiling hydrocarbon liquid effluent materials;

(d) withdrawing used catalyst having an average age of 500–1000 lb coal processed/lb catalyst from said first stage reaction zone and passing the used catalyst forward into said second stage reaction zone for further use therein, and withdrawing from said second reaction zone used catalyst having an average age of 1000–2000 lb coal processed/lb used catalyst;

(e) withdrawing the effluent material from said second stage catalytic reaction zone and phase separating said effluent material into separate gas and liquid fractions;

(f) passing said liquid fraction to distillation steps and a liquid-solids separation step, from which an overhead liquid stream normally boiling above about 650° F. and containing less than 20 W % concentration of particulate solids is recycled to the coal slurrying step; and (g) recovering hydrocarbon gas and increased yields of low boiling $C_4$-650° F. hydrocarbon liquid products from the process.

16. A process for two-stage catalytic hydrogenation of coal to produce low-boiling hydrocarbon liquid and gaseous products, comprising:

(a) feeding particulate coal and a hydrocarbon slurrying oil at oil/coal weight ratio between 1.0 and 4.0 and at temperature below about 650° F. into a pressurized first stage catalytic reaction zone containing coal-derived liquid and hydrogen and an ebullated bed of particulate hydrogenation catalyst;

(b) passing said coal and hydrogen upwardly through said first stage ebullated bed of particulate hydrogenation catalyst, said bed being maintained at 750°–860° F. temperature, 1000–4000 psig hydrogen partial pressure and space velocity of 10–90 lb/hr per $ft^3$ settled catalyst volume to rapidly heat the coal and catalytically hydrogenate it to produce a partially hydrogenated and hydroconverted coal-derived material;

(c) withdrawing said partially hydrogenated coal-derived material containing gas and liquid fractions from said first stage reaction zone, and passing said material to a second stage catalytic reaction zone together with additional hydrogen, said second stage reaction zone being maintained at 700°–800° F. temperature and 1000–4000 psig hydrogen partial pressure for further reacting and hydrocracking the liquid fraction material therein with minimal dehydrogenation reactions to produce gas and lower boiling hydrocarbon liquid effluent materials;

(d) withdrawing used catalyst particles having an average age of about 500–1500 lb coal processed/lb catalyst from said first stage reaction zone, passing the used catalyst forward into said second stage reaction zone and withdrawing from said second stage reaction zone used catalyst having an average age at least about 1000 lb coal processed/Lb catalyst;

(e) withdrawing the effluent material from said second stage catalytic reaction zone and phase separating said effluent material into separate gas and liquid fractions;

(f) passing said liquid fraction to a distillation step and a liquid-solids separation step, from which a hydrocarbon liquid solvent stream normally boiling above about 600° F. and containing less than about 30 W % concentration of particulate solids is recycled as coal slurrying oil; and (g) recovering hydrocarbon gas and increased yields of low boiling $C_4$-650° F. hydrocarbon liquid products from the process.

* * * * *